US008100704B1

(12) United States Patent
Wei

(10) Patent No.: US 8,100,704 B1
(45) Date of Patent: Jan. 24, 2012

(54) COAXIAL CABLE CONNECTOR ASSEMBLY

(75) Inventor: Kai-Chih Wei, Taipei (TW)

(73) Assignee: Ezconn Corporation, Taipei (TW)

( * ) Notice: Subject to any disclaimer, the term of this patent is extended or adjusted under 35 U.S.C. 154(b) by 0 days.

(21) Appl. No.: 13/137,189

(22) Filed: Jul. 27, 2011

(51) Int. Cl.
*H01R 4/66* (2006.01)

(52) U.S. Cl. ..... 439/97

(58) Field of Classification Search ..... 439/92, 439/97, 801, 939
See application file for complete search history.

(56) References Cited

U.S. PATENT DOCUMENTS 6,877,996 B1 * 4/2005 Franks, Jr. ..... 439/92
6,976,884 B1 * 12/2005 Lee ..... 439/638
7,462,042 B2 * 12/2008 Chawgo ..... 439/97
7,909,623 B2 * 3/2011 Lee ..... 439/97

* cited by examiner

*Primary Examiner* — Tho D Ta
(74) *Attorney, Agent, or Firm* — Bacon & Thomas, PLLC

(57) ABSTRACT

A coaxial cable connector assembly includes a bracket defining an upright locating plate and a horizontal holder plate, a coaxial cable connector fastened to the upright locating plate for the connection of a coaxial cable, and a grounding wire connector consisting of an externally threaded male connector member and an internally threaded female connector member and fastened to the horizontal holder plate to hold a grounding wire for discharging of magnetic waves, surge or shocks occurred during signal transmission through the coaxial cable to avoid system damage and to assure signal transmission stability.

9 Claims, 8 Drawing Sheets

COAXIAL CABLE CONNECTOR ASSEMBLY

BACKGROUND OF THE INVENTION

1. Field of the Invention

The present invention relates electrical connectors and more particularly to a coaxial cable connector assembly consisting of a bracket, a grounding wire connector and a coaxial cable connector, which effectively eliminates electromagnetic interference, avoiding system damage and assuring signal transmission stability.

2. Description of the Related Art

CATA (Community Antenna Television) is a cable TV system of providing television to consumers via radio frequency signals transmitted to televisions through coaxial cables or digital light pulses though fixed optical fibers located on the subscriber's property. FM radio programming, high-speed Internet, telephony and other non-television services may also be provided.

Coaxial cables of a cable TV system are exposed to the outside of the community building and can easily be damaged by a high voltage produced upon a thunder strike. When a TV system or any other electronic equipment is attacked by a thunder strike or strong magnetic waves, the system or equipment circuit may be fatally damaged.

To decrease in induction voltage on a coaxial cable, a grounding arrangement is necessary for discharge of magnetic waves and noises, assuring impedance matching and avoiding transmission energy loss.

FIG. 8 illustrates a ground isolation coaxial cable connector according to the prior art. According to this design, the ground isolation coaxial cable connector comprises an electric connector member A, a stepped bracket B and a lock screw B13. The stepped bracket B comprises two mounting lugs B1 disposed at two opposite lateral sides thereof, a horizontal through hole B11 disposed adjacent to one mounting lug B1 for the insertion of a grounding wire D, and a screw hole B12 vertically disposed in communication with the horizontal through hole B11. The electric connector member A is fastened to the stepped bracket B for the connection of a coaxial cable C. After insertion of the grounding wire D through the horizontal through hole B11, the lock screw B13 is threaded into the screw hole B12 to lock the grounding wire D. According to this design, the stepped bracket B is made by means of metal injection molding. The tooling cost for the fabrication of the stepped bracket B is quite expensive. Further, because the lock screw B13 is directly stopped against the periphery of the grounding wire D, the periphery of the grounding wire D may be damaged by the lock screw B13 easily, causing increase of impedance.

Therefore, it is desirable to provide a coaxial cable connector, which eliminates the drawbacks of the aforesaid prior art design.

SUMMARY OF THE INVENTION

The present invention has been accomplished under the circumstances in view. It is the main object of the present invention to provide a coaxial cable connector assembly, which effectively eliminates electromagnetic interference, avoiding system damage and assuring signal transmission stability.

To achieve this and other objects of the present invention, a coaxial cable connector assembly comprises a bracket defining an upright locating plate and a horizontal holder plate, a coaxial cable connector fastened to a through hole on the upright locating plate for the connection of a coaxial cable, and a grounding wire connector consisting of an externally threaded male connector member and an internally threaded female connector member and fastened to a receiving hole on the horizontal holder plate to hold a grounding wire for discharging of magnetic waves, surge or shocks occurred during signal transmission through the coaxial cable to avoid system damage and to assure signal transmission stability. The externally threaded male connector member has a wire hole transversely cut through the shank thereof for the insertion of the grounding wire. The internally threaded female connector member is rotatable on the shank of the externally threaded male connector member to lock/unlock the grounding wire.

Further, the bracket further comprises at least one flat bearing edge defined in the receiving hole on the horizontal holder plate. The externally threaded male connector member further comprises at least one cut plane vertically located on the periphery of the shank thereof around the wire hole and respectively attached to the at least one flat bearing edge of the bracket to prohibit rotation of the grounding wire connector relative to the bracket.

Further, the bracket is made of a single piece metal plate member by means of stamping technology, facilitating fabrication, and saving much material consumption and reducing the manufacturing cost.

The grounding wire connector further comprises a washer attached to the shank of the male connector member and stopped between the grounding wire and the female connector member to prevent direct contact between the female connector member and the grounding wire, avoiding friction damage and assuring excellent ground effects.

DETAILED DESCRIPTION OF THE PREFERRED EMBODIMENT

Figure 1:
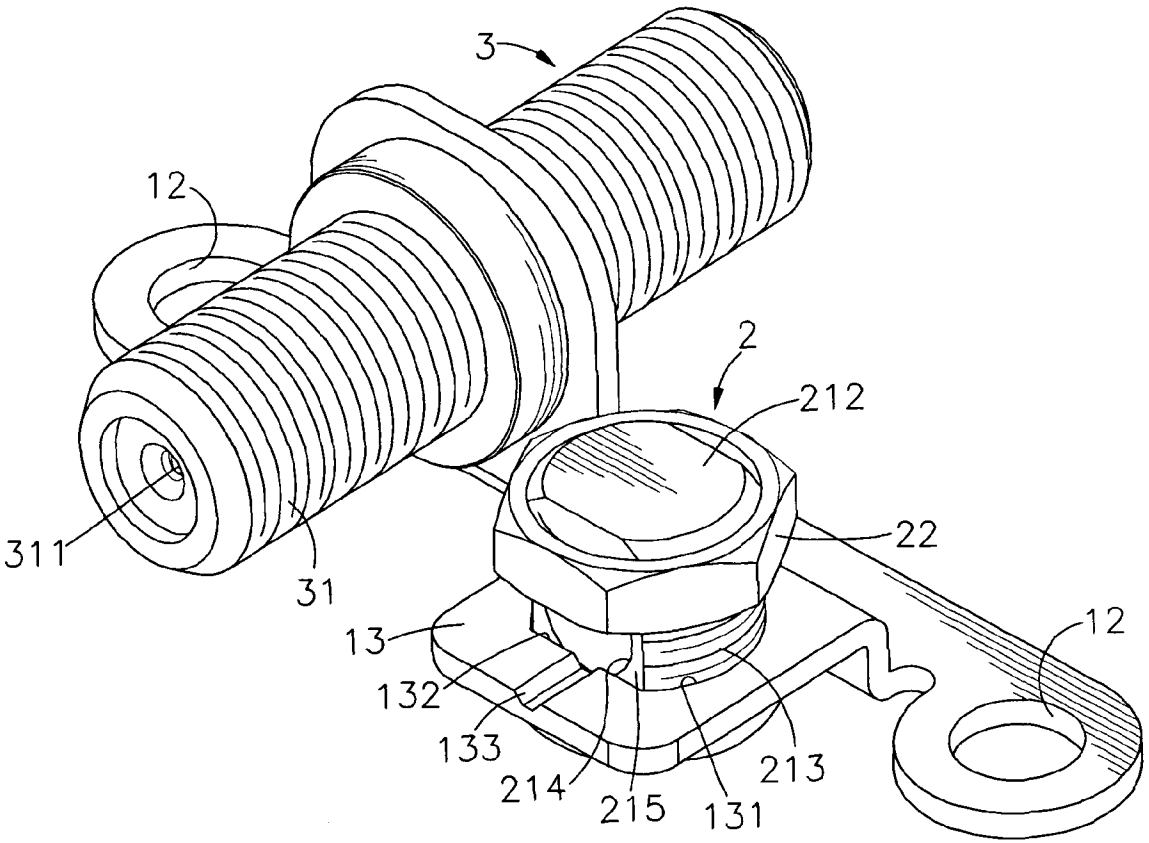
FIG. 1 is an elevational view of a coaxial cable connector assembly in accordance with the present invention.
Figure 2:
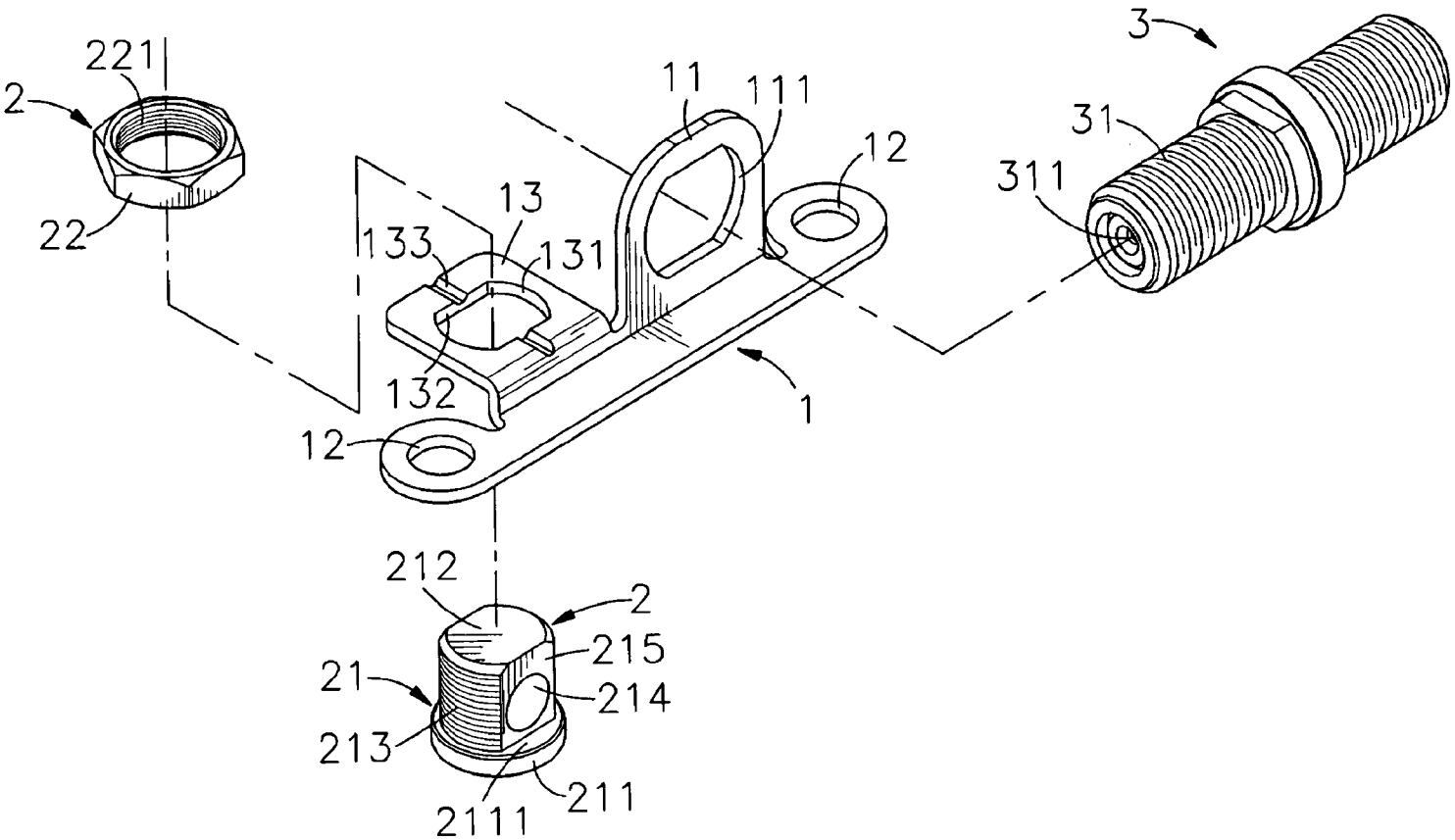
FIG. 2 is an exploded view of the coaxial cable connector assembly in accordance with the present invention.
Figure 3:
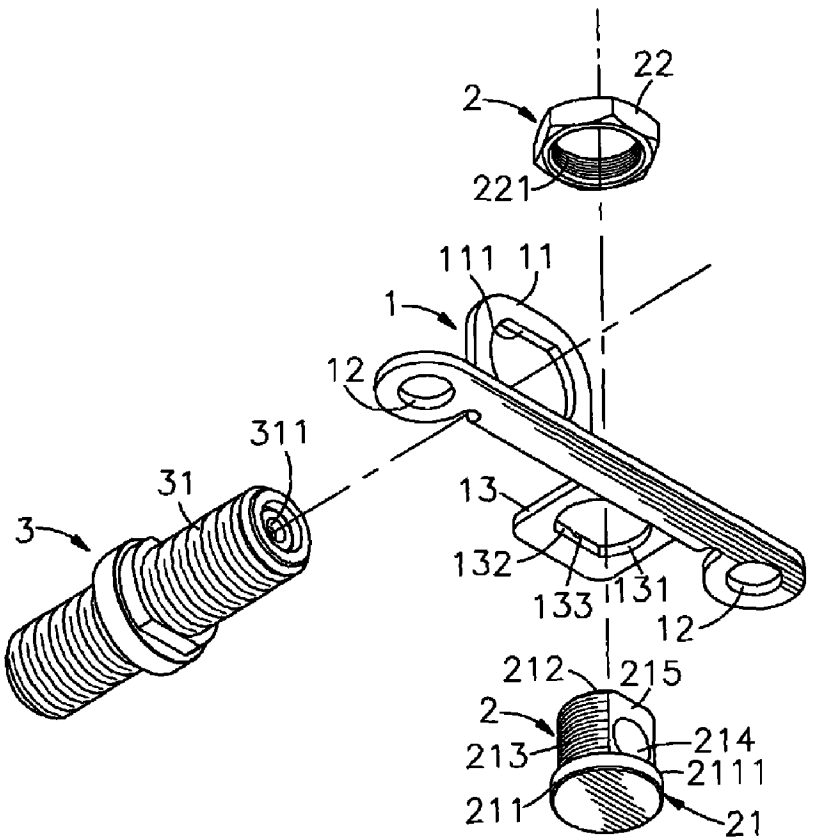
FIG. 3 corresponds to FIG. 2 when viewed from another angle.

Referring to FIGS. 1-3, a coaxial cable connector assembly in accordance with the present invention is shown comprising a bracket 1, a grounding wire connector 2, and a coaxial cable connector 3.

The bracket 1 is made of a single piece metal plate member by means of stamping technology, comprising an upright locating plate 11, at least one, for example, one through hole 111 horizontally cut through the upright locating plate 11 for receiving the coaxial cable connector 3, at least one, for example, two mounting eyelets 12 horizontally disposed at two opposite lateral sides thereof, a horizontal holder plate 13 horizontally disposed at one lateral side relative to the upright locating plate 11 above the elevation of the mounting eyelets 12, a receiving hole 131 vertically cut through the horizontal holder plate 13, at least one flat bearing edge 132 defined in the receiving hole 131, and a V-groove 133 located on the top wall of the horizontal holder plate 13 and extending across the receiving hole 131 in a parallel manner relative to the axis of the through hole 111.

The grounding wire connector 2 is mountable in the receiving hole 131 of the horizontal holder plate 13 of the bracket 1, comprising a male connector member 21 and a female connector member 22. The male connector member 21 is a screw member comprising a head 211 located on one end thereof and stoppable at the bottom side of the horizontal holder plate 13, a shank 212 perpendicularly extended from the head 211 and insertable through the receiving hole 131 of the horizontal holder plate 13, outer threads 213 extending around the periphery of the shank 212, a wire hole 214 of circular, oval, rectangular or polygonal configuration transversely cut through the shank 212 in a parallel manner relative to the axis of the through hole 111, and at least one cut plane 215 vertically located on the periphery of the shank 212 around the wire hole 214. The female connector member 22 is a nut having inner threads 221 threadable onto the outer threads 213 of the male connector member 21.

The coaxial cable connector 3 is a metal cylindrical member having outer threads 31 extending around the periphery thereof and a center contact hole 311 axially disposed at the center thereof.

Figure 4:
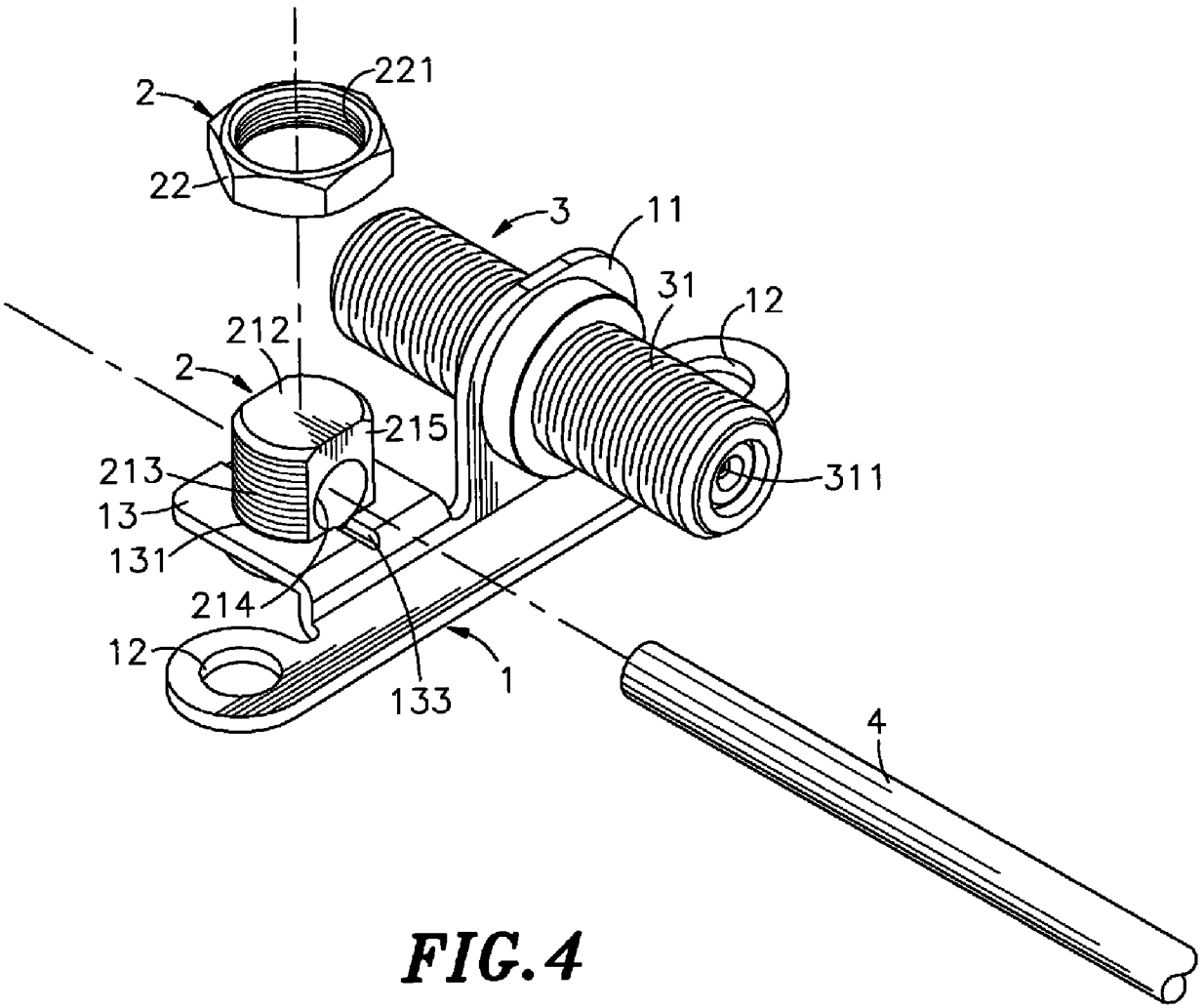
FIG. 4 is an applied view of the present invention before installation of the grounding wire.
Figure 5:
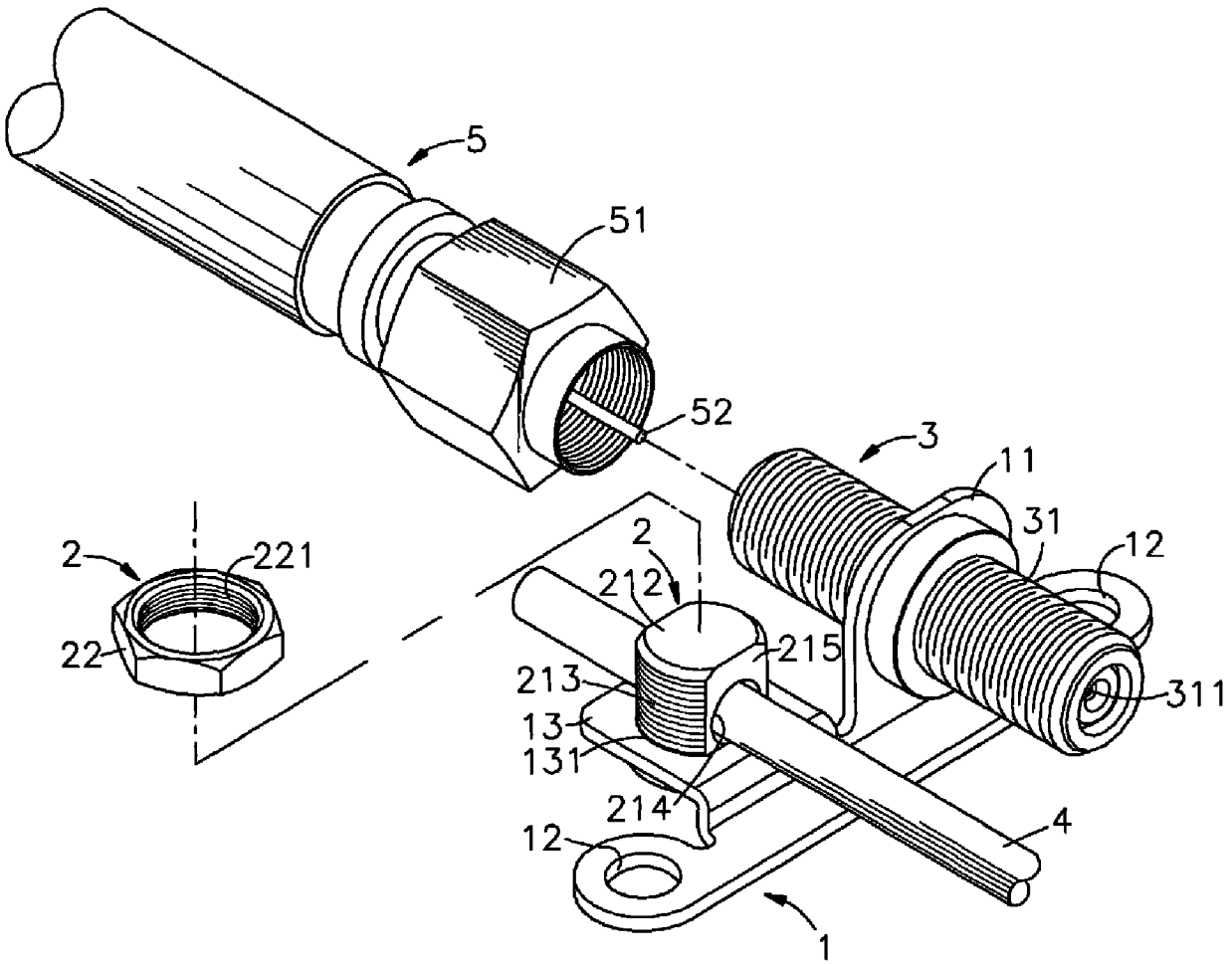
FIG. 5 corresponds to FIG. 4, illustrating the grounding wire inserted through the wire hole of the male connector member before installation of the female connector member and the coaxial cable.
Figure 6:
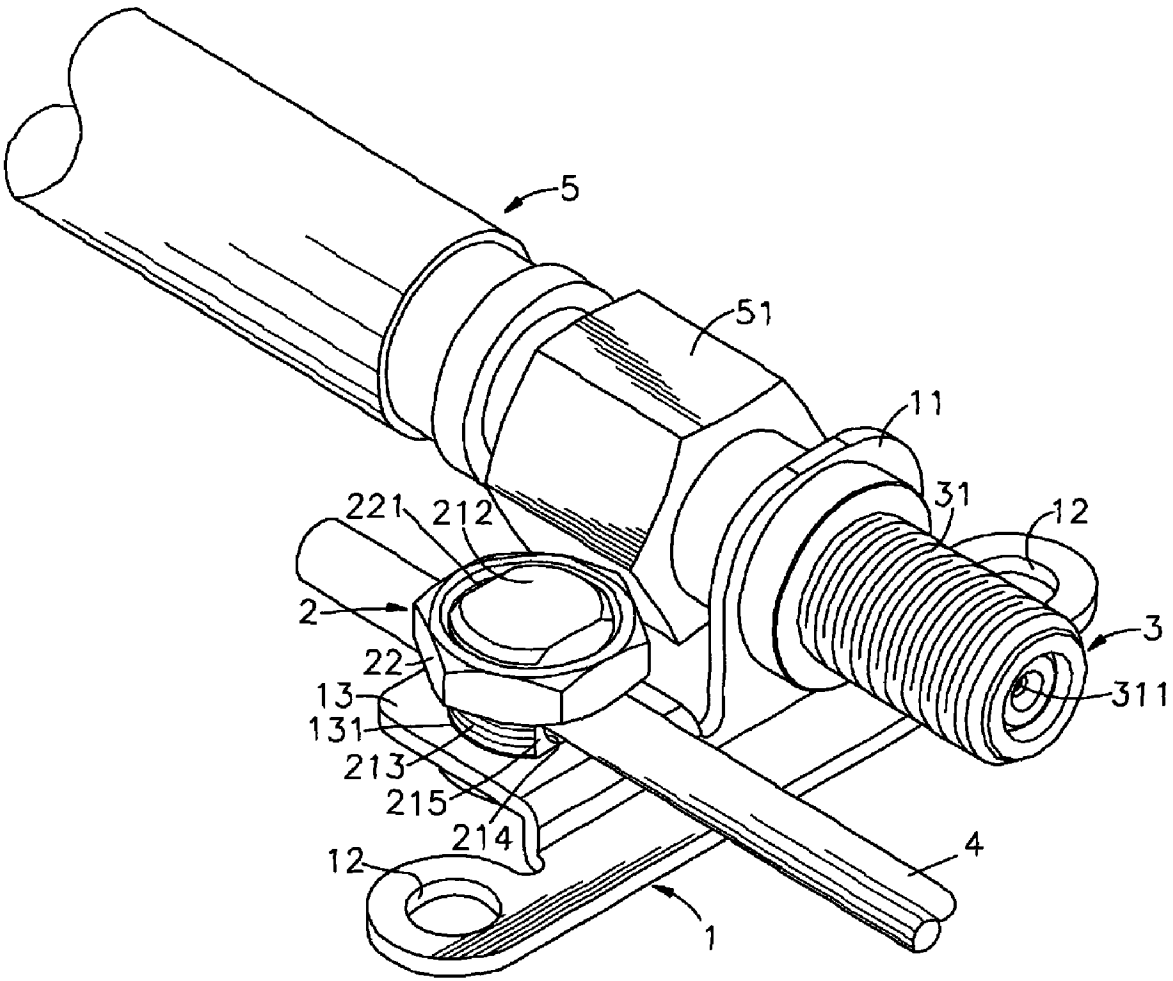
FIG. 6 corresponds to FIG. 5, illustrating the female connector member fastened to the shank of the male connector member and the coaxial cable connected to the coaxial cable connector.

Referring to FIGS. 4-6, during installation of the present invention, insert the shank 212 of the male connector member 21 vertically upwardly or downwardly through the receiving hole 131 of the horizontal holder plate 13 to stop an inner stop wall 2111 of the head 211 of the male connector member 21 around the shank 212 at the bottom side of the horizontal holder plate 13 and to keep the at least one cut plane 215 in contact with the at least one flat bearing edge 132 of the horizontal holder plate 13, and then insert a grounding wire 4 through the wire hole 214 of the male connector member 21, and then fasten the female connector member 22 to the male connector member 21 by threading the inner threads 221 onto the outer threads 213 to lock the male connector member 21 to the horizontal holder plate 13 and also to lock the grounding wire 4 to the wire hole 214 of the male connector member 21.

When inserting the shank 212 of the male connector member 21 vertically upwardly or downwardly through the receiving hole 131 of the horizontal holder plate 13, the at least one cut plane 215 is kept in contact with the at least one flat bearing edge 132 of the horizontal holder plate 13. Subject matching between the at least one cut plane 215 and the at least one flat bearing edge 132, the male connector member 21 is prohibited from rotation relative to the horizontal holder plate 13. Further, the grounding wire 4 is kept attached to the V-groove 133 at the top wall of the horizontal holder plate 13, assuring positive and accurate positioning.

Thereafter, mount the coaxial cable connector 3 in the through hole 111 of the upright locating plate 11 of the bracket 1, and then insert the center conductor, referenced by 52, of a coaxial cable 5 into the center contact hole 311 of the coaxial cable connector 3, and then thread the locknut, referenced by 51, onto the outer threads 31 of the coaxial cable connector 3 to lock the coaxial cable 5 and the coaxial cable connector 3 to the upright locating plate 11 of the bracket 1.

Further, by means of the mounting eyelets 12, the bracket 1 can be fixedly fastened to a CCTV (closed circuit television) system or any other video equipment. If any magnetic waves, surge or shocks occurred during signal transmission through the coaxial cable 5, they will be released through the grounding wire 4, avoiding system damage and assuring signal transmission stability.

Further, the head 211 of the male connector member 21 can be stepped-configured for engagement into the receiving hole 131 of the horizontal holder plate 13 positively to keep the wire hole 214 of the male connector member 21 between the horizontal holder plate 13 and the female connector member 22 for allowing insertion of the grounding wire 4. After insertion of the grounding wire 4 through the wire hole 214 of the male connector member 21, the female connector member 22 is fastened tight to lock the male connector member 21, the grounding wire 4 and the horizontal holder plate 13 together. In an alternate form of the present invention, the wire hole 214 of the male connector member 21 is disposed between the head 211 and the horizontal holder plate 13, and the female connector member 22 is threaded onto the shank 212 of the male connector member 21 above the horizontal holder plate 13. As stated above, the bracket 1 is made of a single piece metal plate member by means of stamping technology, facilitating fabrication. When compared to metal injection molding, the fabrication of the bracket 1 according to the present invention consumes less amount of material, thereby reducing the manufacturing cost.

Figure 7:
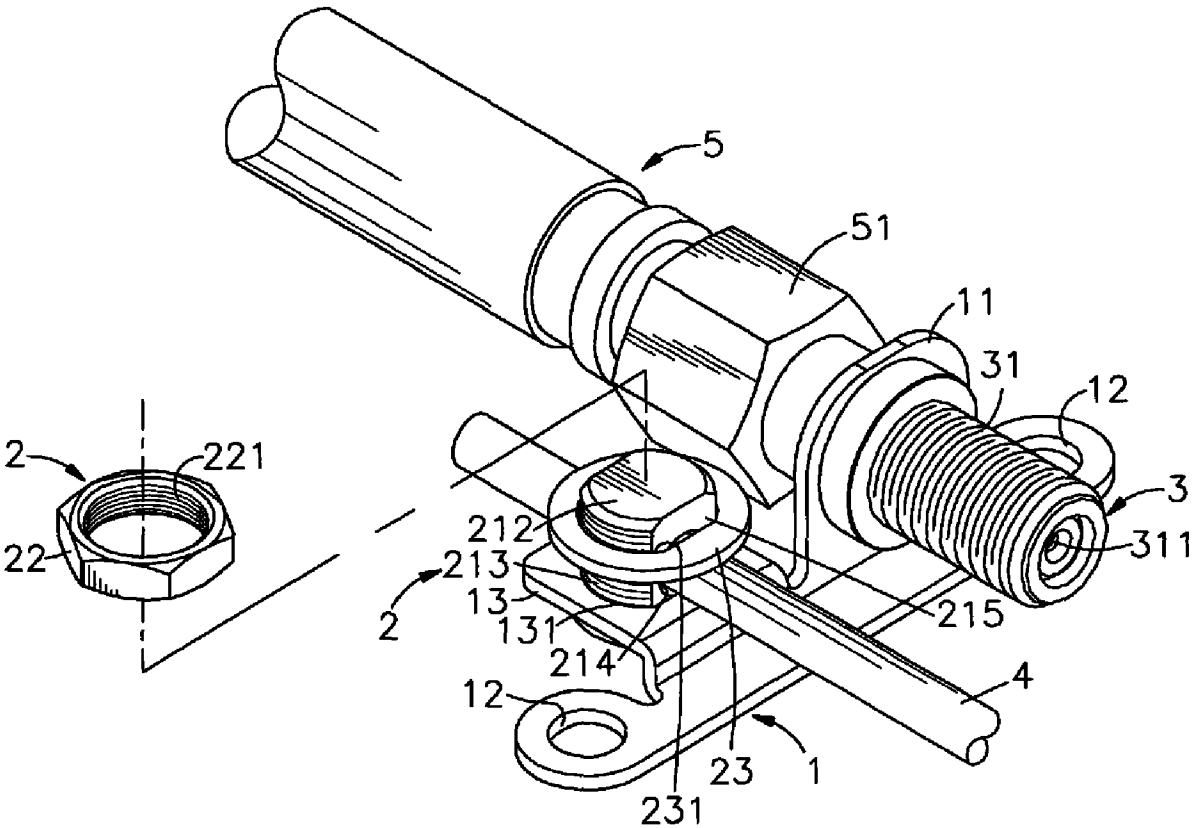
FIG. 7 corresponds to FIG. 6, illustrating the female connector member removed from the male connector member and a washer attached to the shank of the male connector member.
Figure 8:
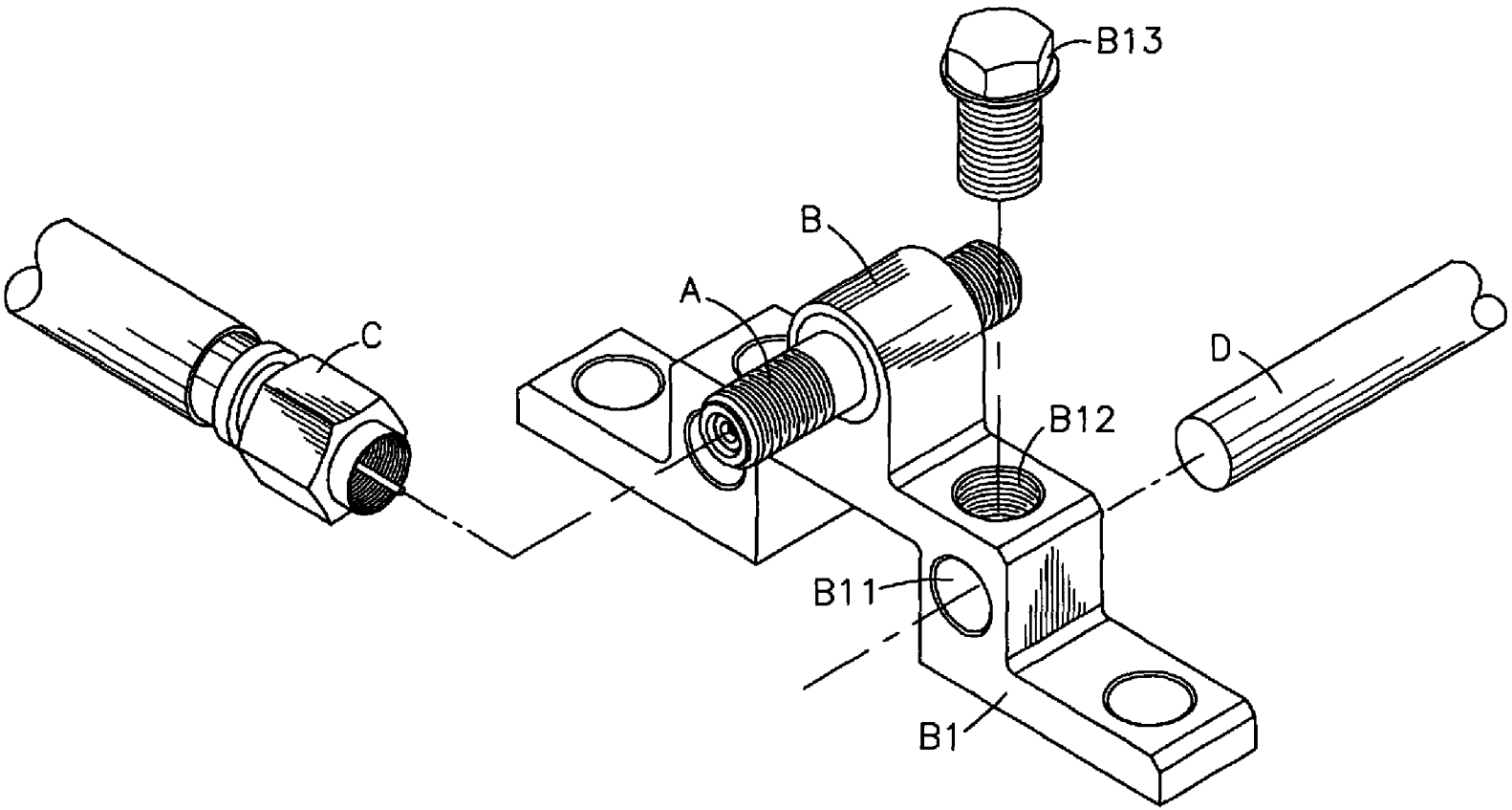
PRIOR ART FIG.8
FIG. 8 is an exploded view of a ground isolation coaxial cable connector according to the prior art.

Referring to FIG. 7 and FIG. 2 again, the grounding wire connector 2 further comprises a washer 23 attached to the shank 212 of the male connector member 21 and stopped at one side of the female connector member 22. When rotating the female connector member 22 relative to the shank 212 of the male connector member 21, the washer 23 is moved along the shank 212 to adjust the gap between the washer 23 and the horizontal holder plate 13, thereby locking or unlocking the grounding wire 4. Further, the washer 23 has at least one cut plane 231 fitting the at least one cut plane 215 of the male connector member 21. Subject to the use of the washer 23, the female connector member 22 is prohibited from direct contact with the grounding wire 4, avoiding friction damage and assuring positive excellent ground effect.

In conclusion, the invention provides a coaxial cable connector assembly, which comprises a bracket 1, which comprises an upright locating plate 11, two mounting eyelets 12 and a horizontal holder plate 13, a grounding wire connector 2, which comprises a male connector member 21 inserted through a receiving hole 131 on the horizontal holder plate 13 and adapted to hold a grounding wire 4 in a wire hole 214 on a threaded shank 212 thereof and a female connector member 22 threaded onto the threaded shank 212 to lock the grounding wire 4 to the horizontal holder plate 13, and a coaxial cable connector 3 fastened to a through hole 111 on the upright locating plate 11 of the bracket 1 for the connection of a coaxial cable 5. Subject to the use of the grounding wire to discharge magnetic waves, surge or shocks occurred during signal transmission through the coaxial cable 5, the invention avoids system damage and assures signal transmission stability.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A coaxial cable connector assembly, comprising:

a bracket comprising an upright locating plate, at least one mounting eyelet for mounting, a horizontal holder plate horizontally disposed at one lateral side relative to said upright locating plate and a receiving hole vertically cut through said horizontal holder plate;

a grounding wire connector, said grounding wire connector comprising a male connector member mounted in said receiving hole of said horizontal holder plate to hold a grounding wire and a female connector member fastened to said male connector member to lock said grounding wire, said male connector member comprising a head located on one end thereof and stopped at one side of said horizontal holder plate, a shank perpendicularly extended from said head and inserted through said receiving hole of said horizontal holder plate, and a wire hole transversely cut through said shank, said female connector member being fastened to said shank of said male connector member to lock said grounding wire and said male connector member to said horizontal holder plate; and at least one coaxial cable connector fastened to said upright locating plate of said bracket for the connection of one respective coaxial cable.

2. The coaxial cable connector assembly as claimed in claim 1, wherein said bracket is a single-piece metal plate member.

3. The coaxial cable connector assembly as claimed in claim 1, wherein said upright locating plate of said bracket comprises at least one through hole for receiving said at least one coaxial cable connector respectively.

4. The coaxial cable connector assembly as claimed in claim 1, wherein said bracket further comprises at least one flat bearing edge defined in said receiving hole; said male connector member further comprises at least one cut plane vertically located on the periphery of said shank around said wire hole and respectively attached to said at least one flat bearing edge of said bracket.

5. The coaxial cable connector assembly as claimed in claim 1, wherein said bracket further comprises a V-groove located on a top wall of said horizontal holder plate and extending across said receiving hole for the positioning of said grounding wire.

6. The coaxial cable connector assembly as claimed in claim 1, wherein said male connector member comprises an inner stop wall located on one side of said head adjacent to said shank and stopped at one side of said receiving hole of said horizontal holder plate.

7. The coaxial cable connector assembly as claimed in claim 1, wherein said male connector member further comprises a plurality of outer threads extending around the periphery of said shank; said female connector comprises a plurality of inner threads threaded onto said outer threads of said male connector member.

8. The coaxial cable connector assembly as claimed in claim 1, wherein said grounding wire connector further comprises a washer attached to said shank of said male connector member and stopped between said grounding wire and said female connector member.

9. The coaxial cable connector assembly as claimed in claim 1, wherein said male connector member further comprises at least one cut plane vertically located on the periphery of said shank around said wire hole and respectively attached to said at least one flat bearing edge of said bracket; said grounding wire connector further comprises a washer attached to said shank of said male connector member and stopped between said grounding wire and said female connector member, said washer comprising at least one cut plane fitting the at least one cut plane of said male connector member.

* * * * *